US006220314B1

(12) United States Patent
Sato

(10) Patent No.: US 6,220,314 B1
(45) Date of Patent: Apr. 24, 2001

(54) WASTE-INK COLLECTING APPARATUS

(75) Inventor: Akira Sato, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,978

(22) Filed: Oct. 25, 1999

(30) Foreign Application Priority Data

Oct. 27, 1998 (JP) ..... 10-305464

(51) Int. Cl.[7] ..... B65B 1/04; B65B 3/00; B67C 3/00

(52) U.S. Cl. ..... 141/351; 141/94; 141/100; 141/104; 141/311 R; 141/352; 141/198; 347/36

(58) Field of Search ..... 347/36; 141/83, 141/94, 95, 99, 100, 104, 192, 198, 311 R, 351, 352, 383, 384, 387

(56) References Cited

U.S. PATENT DOCUMENTS 4,556,894 * 12/1985 Terasawa ..... 346/36
5,113,206 * 5/1992 Fukazawa ..... 346/36
5,699,092 * 12/1997 Kawakami et al. ..... 347/29
5,745,134 * 4/1998 Hirabayashi et al. ..... 347/37

FOREIGN PATENT DOCUMENTS 8-99415 4/1996 (JP) .

* cited by examiner

*Primary Examiner*—Timothy L. Maust
(74) *Attorney, Agent, or Firm*—Frishauf, Holtz, Goodman, Langer & Chick, P.C.

(57) ABSTRACT

A waste-ink collecting apparatus comprises a collection box retaining an absorptive member for absorbing waste inks, a holding case for retaining the collection box in a detachable manner, a nozzle unit rotatably attached to the holding case and a housing for rotatably accommodating the holding case. The nozzle unit has a waste-ink nozzle for disposing waste ink and an air-discharge nozzle for discharging ink mist. When the collection box is installed in the holding case, a pressure surface placed in the holding case is pressed by the collection box via an opening in the holding case and the nozzle unit is rocked against the urging force of an a spring, setting the individual nozzles to a waste position where waste ink and ink mist can be disposed. When the collection box is pulled out of the holding case, the nozzle unit is rocked by the urging force of the a spring, setting the individual nozzles to a standby position where waste ink and ink mist cannot be disposed.

15 Claims, 8 Drawing Sheets

WASTE-INK COLLECTING APPARATUS

BACKGROUND OF THE INVENTION

The present invention relates to a waste-ink collecting apparatus for an ink-jet printer, and, more particularly, to a waste-ink collecting apparatus which collects waste inks to be discharged at the time of maintenance of a recording head that ejects ink.

An ordinary ink-jet printer has a recording head so arranged as to face a recording medium which is to be fed in a predetermined direction. The recording head has a plurality of nozzles aligned in a direction approximately perpendicular to the feeding direction of the recording medium. In printing characters or an image on a recording medium, the recording medium is fed at a constant speed in a predetermined direction and ink is selectively ejected from the nozzles of the recording head.

To accomplish high-resolution printing, the nozzles of a recording head are designed to have a very small diameter and are arranged close to one another at a high density. As the nozzles are made narrow, the nozzles are likely to clog with the passage of time. To prevent clogging of the nozzles of the recording head, the nozzles should be cleaned regularly.

In cleaning the nozzles of the recording head, the recording head is driven to discharge foreign matters and gases from the nozzles with a recording medium unfed. At this time, the waste inks discharged from the nozzles is retained in a predetermined ink retainer.

An air-liquid separation chamber is connected to the ink retainer via a waste-ink tube. Connected to the air-liquid separation chamber is a suction pump which generates negative pressure in the chamber. A filter for trapping an ink mist contained in the discharged gas is provided on the air-discharge side of the suction pump.

When the suction pump is driven, negative pressure is generated in the air-liquid separation chamber, causing the waste inks in the ink retainer to flow into the air-liquid separation chamber via the waste-ink tube. The ink mist discharged via the suction pump is trapped by the filter.

The waste inks that have flown into the air-liquid separation chamber are collected in a waste-ink collection tank by a liquid-discharge pump connected to the air-liquid separation chamber. When the waste-ink collection tank becomes full of waste ink, it is separated from a liquid-discharge tube led out from the liquid-discharge side of the liquid-discharge pump and removed.

With the above conventional structure, if a filter with a rough mesh is selected in consideration of the air discharging performance of the suction pump, it is not possible to completely trap the ink mist contained in the discharged air so that a waste ink is discharged in the air.

As the waste-ink collection tank is designed to be removable after it is separated from the liquid-discharge tube, waste inks are likely to leak from the portion where the waste-ink collection tank is connected to the liquid-discharge tube. The conventional structure therefore requires a collection mechanism for collecting the waste inks that have leaked from the connected portion between the tank and the tube.

BRIEF SUMMARY OF THE INVENTION

Accordingly, it is an object of the present invention to provide a waste-ink collecting apparatus which is simple in structure and which can prevent waste inks from staining the interior of a printer.

To achieve the above object, a waste-ink collecting apparatus according to one aspect of this invention comprises a collection box for collecting waste ink; a holding case for retaining the collection box in a detachable manner; a nozzle unit attached to the holding case, having nozzles for disposing waste ink to the collection box and movable between a waste position where the waste inks are disposable through the nozzles and a standby position where the waste inks are not disposable; and an urging member for urging the nozzle unit to the standby position, whereby installing the collection box in the holding case moves the nozzle unit to the waste position an urging force of the urging member and removing the collection box from the holding case causes the urging member to move the nozzle unit to the standby position.

According to another aspect of this invention, there is provided a waste-ink collecting apparatus which comprises a collection box retaining an absorptive member for absorbing and holding waste inks; a holding case for retaining the collection box in a detachable manner; a nozzle unit rotatably attached to the holding case, having nozzles for disposing waste inks to the absorptive member and rotatable between a waste position where the waste inks are disposable through the nozzles and a standby position where the waste inks are not disposable; first urging member, provided between the holding case and the nozzle unit, for urging the nozzle unit to the standby position; a housing accommodating the holding case in an elevatable manner between a predetermined upper end position and a predetermined lower end position; second urging member, provided between the housing and the holding case, for urging the holding case to the upper end position, whereby installing the collection box in the holding case rotates the nozzle unit to the waste position against an urging force of the first urging means and removing the collection box from the holding case causes the first urging member to rotate the nozzle unit to the standby position, and wherein the holding case is elevated downward to the lower end position by a dead weight thereof against an urging force of the second urging means when the absorptive member absorbs a predetermined amount of waste inks.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A preferred embodiment of the present invention will now be described with reference to the accompanying drawings.

Figure 1:
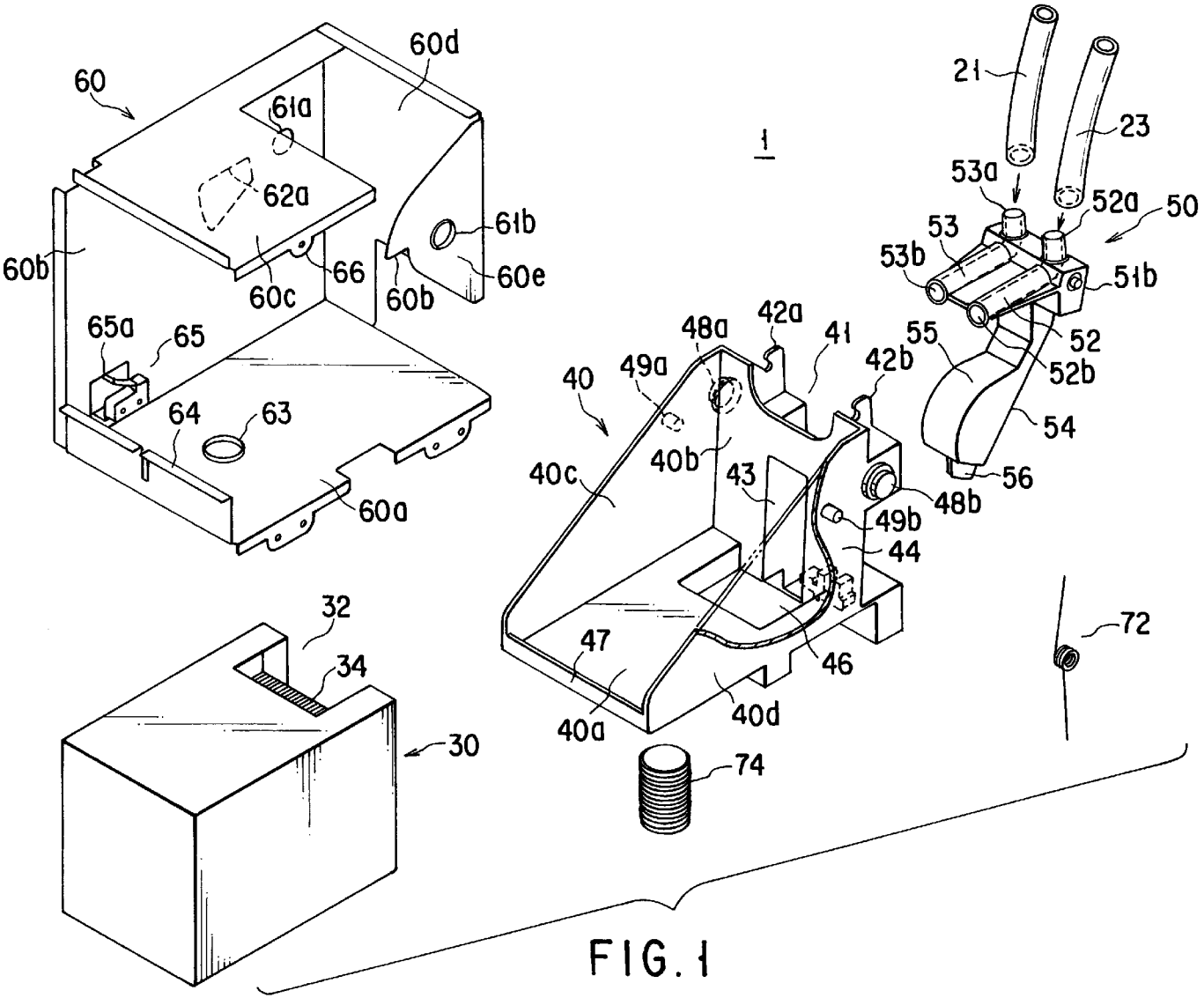
FIG. 1 is an exploded perspective view illustrating a waste-ink collecting apparatus according to one embodiment of this invention disassembled into a plurality of constituting elements.

FIG. 1 presents an exploded perspective view of a waste-ink collecting apparatus (hereinafter simply called "collecting apparatus") 1 according to one embodiment of this invention.

A collecting apparatus 1 comprises a collection box 30 retaining an absorptive member 34 which absorbs waste inks, a holding case 40 for detachably holding this collection box 30, a nozzle unit 50 which is rotatably installed in the holding case 40 and a housing 60 in which the holding case 40 to which the collection box 30 and the nozzle unit 50 are attached is accommodated in a rotatable manner. An a spring 72 as first urging member for urging the nozzle unit 50 is intervened between the holding case 40 and the nozzle unit 50. A spring 74 as second urging member for urging the holding case 40 is intervened between the housing 60 and the holding case 40.

Figure 2:
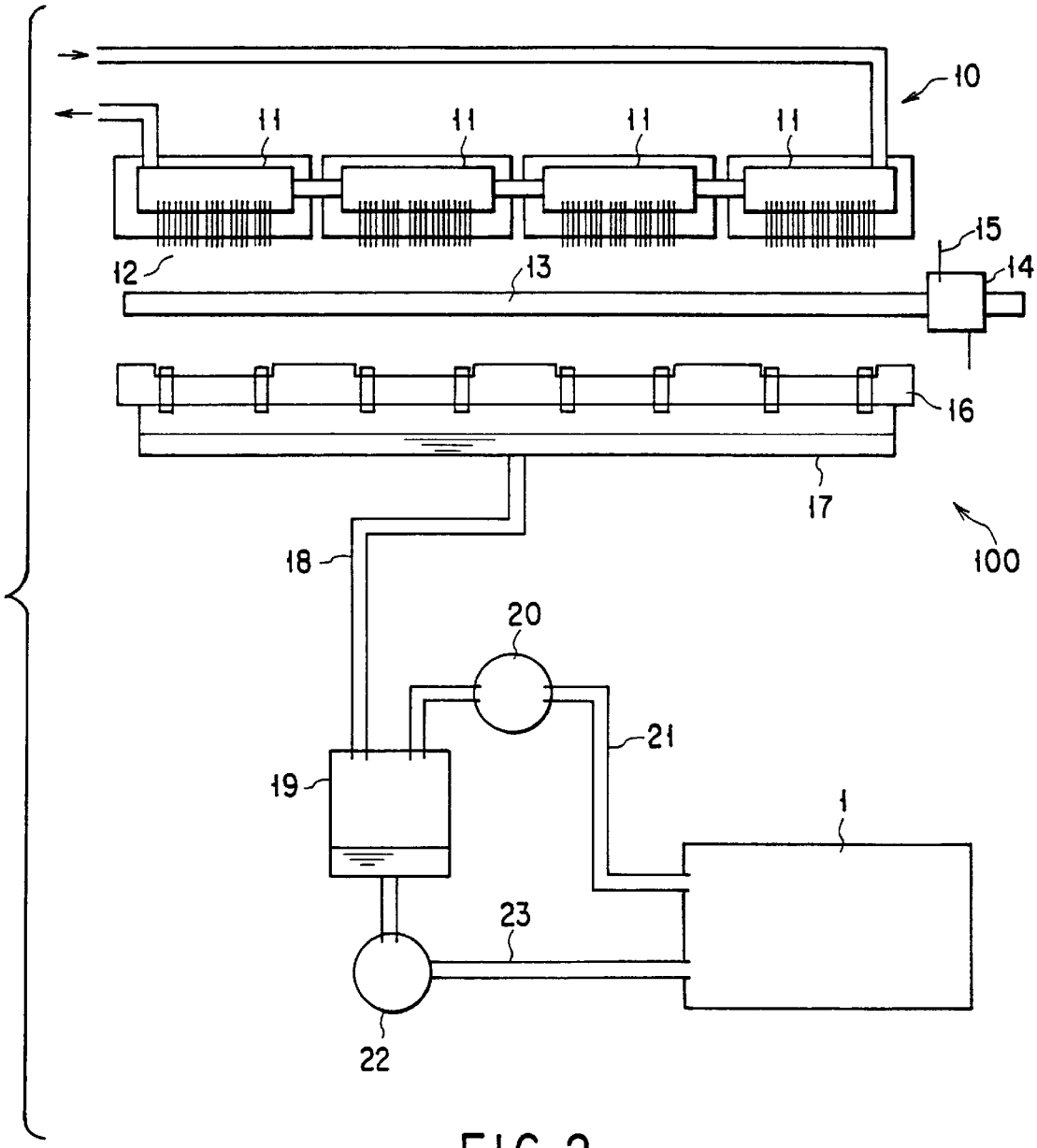
FIG. 2 is a perspective view showing a cleaning mechanism of a recording head in which the waste-ink collecting apparatus in FIG. 1 is installed.

Before going into the discussion of the detailed structure of the collecting apparatus 1 in FIG. 1, a cleaning mechanism 100 of an ink-jet printer to which this invention is applied will be described referring to FIG. 2. This cleaning mechanism 100 includes the collecting apparatus 1 of this invention, and regularly cleans a recording head 10 of the ink-jet printer.

The recording head 10 has a plurality of ink chambers 11 which retain inks of predetermined colors supplied from unillustrated ink tanks. Each ink chamber 11 has multiple nozzles 12 protruding toward an unillustrated recording medium which is fed in the sheet feeding direction (sub scan direction) below the recording head 10. The multiple nozzles 12, e.g., about 2000 nozzles, are aligned along in the main scan direction (right and left direction in the figure) perpendicular to a feeding direction of the recording medium. When this recording head 10 is driven, the inks in the individual ink chambers 11 are selectively ejected from the multiple nozzles 12, thus forming a predetermined image on the recording medium that is fed at a constant velocity.

The cleaning mechanism 100 has a slide rail 13 extending under the recording head 10 in the main scan direction, and a slider 14 attached to be movable in the main scan direction along this rail 13. Attached to the upper portion of the slider 14 is a blade 15 which slides in contact with the distal ends of the multiple nozzles 12. Provided below the slide rail 13 are a maintenance stage 16 which receives waste inks discharged from the multiple nozzles 12 and a reception tank 17 which collects the waste inks received by the maintenance stage 16.

In cleaning the recording head 10, first, with the recording medium unfed, the recording head 10 is driven to eject the inks from all the nozzles 12 to discharge foreign matters and gases remaining in the nozzles 12. At this time, the waste inks containing the foreign matters and gases discharged from the nozzles 12 are collected in the reception tank 17 via the maintenance stage 16. Then, the slider 14 is slid along the slide rail 13, causing the blade 15 to slide in contact with the distal ends of the nozzles 12. At this time, the waste inks collected by the blade 15 are likewise collected in the reception tank 17. The waste inks collected in the reception tank 17 in this manner contain air.

An air-liquid separation chamber 19 is connected via a suction tube 18 to the bottom of the reception tank 17. The air-liquid separation chamber 19 is set in an air-tight state. Connected to the top portion of the air-liquid separation chamber 19 is a suction pump 20 which sucks air out of the air-liquid separation chamber 19 to generate negative pressure. The air-discharge end of the suction pump 20 is connected via an air-discharge tube 21 to the collecting apparatus 1. connected to the bottom of the air-liquid separation chamber 19 is a waste-ink pump 22 which sucks and discharges the waste inks retained in the air-liquid separation chamber 19. The liquid-discharged end of the waste-ink pump 22 is connected to the collecting apparatus 1 via a liquid-discharge tube 23.

In a case where the collecting apparatus 1 collects the waste inks collected in the reception tank 17, the suction pump 20 is driven to generate negative pressure in the air-liquid separation chamber 19. This causes the waste ink in the reception tank 17 to be sucked via the suction tube 18 into the air-liquid separation chamber 19 where the ink is separated into a gas (air) and a liquid (waste ink). At this time, the air sucked by the suction pump 20 slightly contains an ink mist. The ink-mist containing air sucked by the suction pump 20 is led to the collecting apparatus 1 via the air-discharge tube 21. Meanwhile, the waste ink sucked into the air-liquid separation chamber 19 is led to the collecting apparatus 1 via the liquid-discharge tube 23 as the waste-ink pump 22 is driven.

With the above-described structure, as the ink-mist containing air discharged from the air-liquid separation chamber 19 is collected by the collecting apparatus 1, unlike in the prior art, it is unnecessary to provide a filter for trapping an ink mist on the air-discharge side of the suction pump 20. This invention can employ the suction pump 20 of a lower discharging performance than the conventional structure that needs such a filter, and the capacity of the suction pump 20 can be made relatively smaller, thereby contributing to making the apparatus smaller. And because the ink-mist containing air is collected by the collecting apparatus 1, the ink mist will not be discharged in the air.

Figure 3:
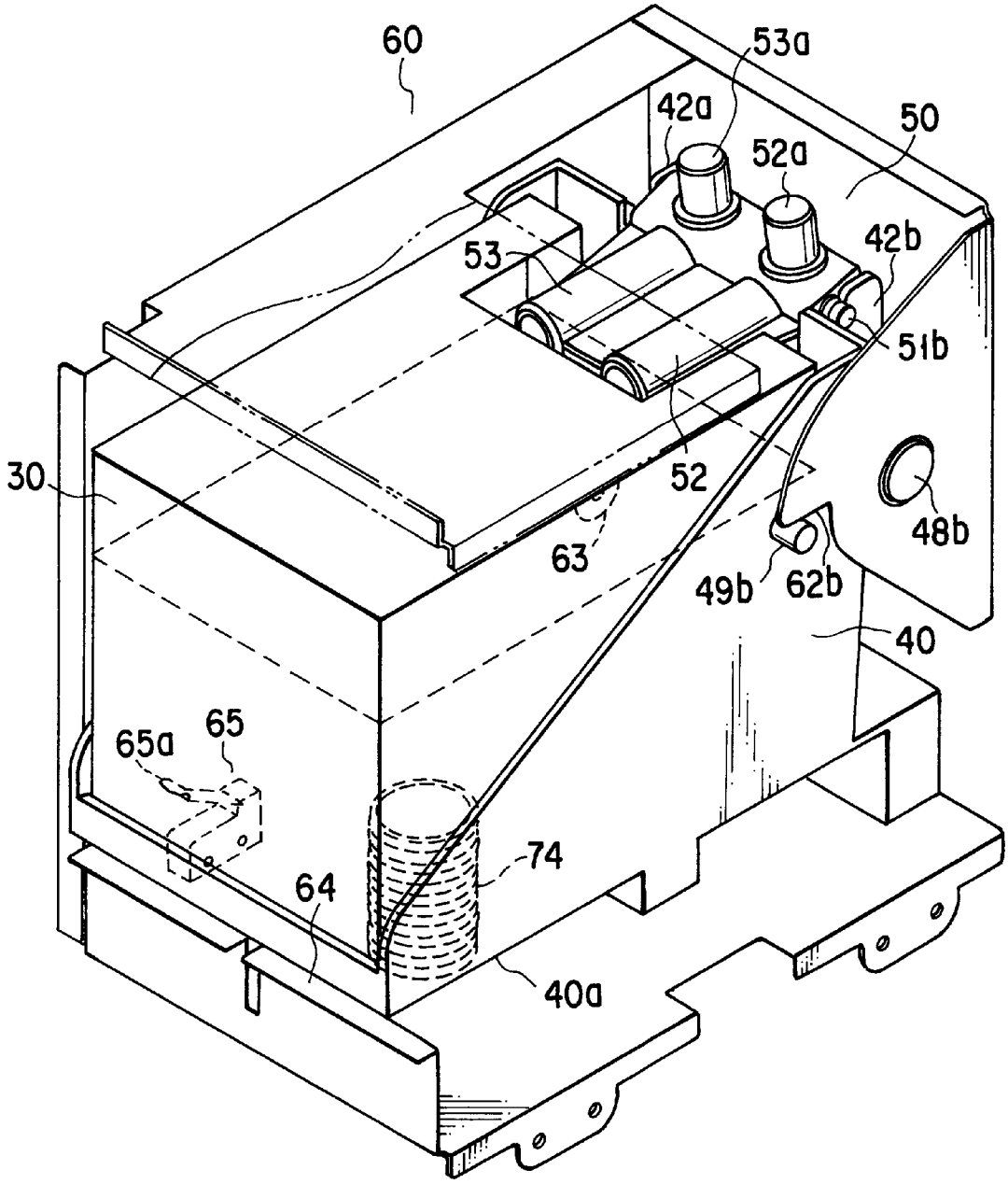
FIG. 3 is a perspective view showing the individual constituting elements assembled together.

The details of the collecting apparatus 1 will now be described referring to FIGS. 1, 3 and 4. FIG. 3 presents a perspective view showing the individual elements assembled together, and FIG. 4 presents a perspective view depicting the holding case 40 in which the nozzle unit 50 is installed and the collection box 30 separated from the holding case 40.

Figure 4:
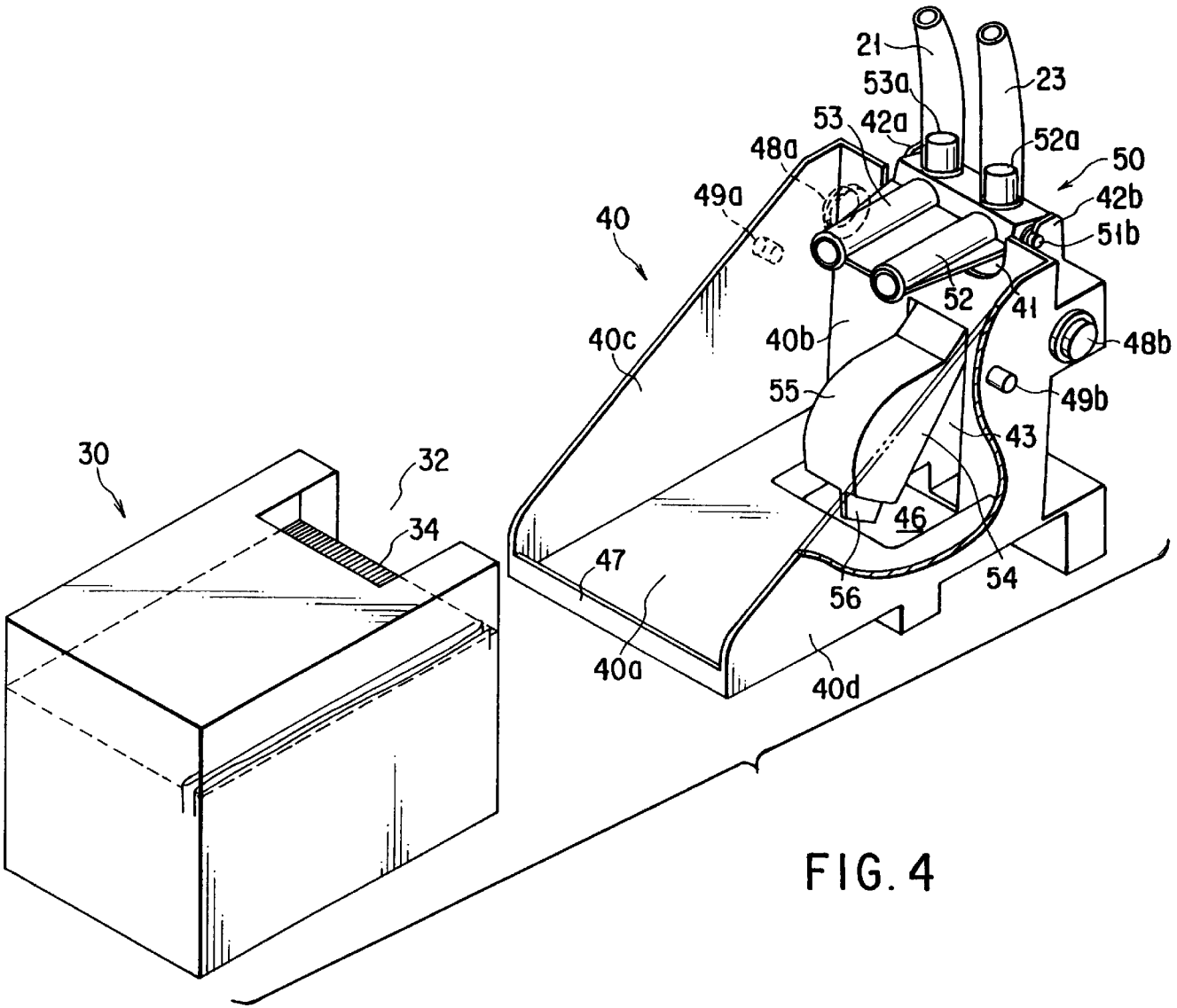
FIG. 4 is a perspective view depicting a holding case in which a nozzle unit of the waste-ink collecting apparatus in FIG. 1 is installed and a collection box.

As shown in FIG. 4, the collection box 30 is designed into an approximately parallelepiped shape, and is made of an inexpensive disposable material like thick paper. Formed in the upper portion of one side of the collection box 30 along the lengthwise direction is an opening 32 for receiving two nozzles 52 and 53 (to be discussed later) of the nozzle unit 50. Retained in the collection box 30 is the absorptive member 34 which absorbs waste inks (ink mists) that are led through the nozzles 52 and 53 of the nozzle unit 50. The absorptive member 34 is partially exposed through the opening 32 in the collection box 30.

The absorptive member 34 is formed by stacking a plurality of paper sheets or accordion-folding at least a single paper sheet. This absorptive member 34 is accommodated in the collection box 30 in such a way that the paper sheets extend vertically. Although FIG. 4 shows the paper sheets extending toward the nozzle unit 50 in the lengthwise direction of the collection box 30, the absorptive member 34 may be arranged in such a way that the paper sheets extend in the widthwise direction perpendicular to the lengthwise direction. When the absorptive member 34 is set in the collection box 30 in such a manner that the paper sheets extend vertically, the absorption of the waste inks led via the nozzle unit 50 gets better, ensuring efficient absorption of the waste inks, as compared with a case where the paper sheets are stacked vertically. This was confirmed empirically.

The collection box 30 is to be replaced with a new one when the absorptive member 34 absorbs a predetermined amount of waste inks. The timing for replacement of the collection box 30 will be discussed later. At the time of replacing the collection box 30 with a new one, the old collection box 30 is removed from the holding case 40 and is disposed, or only the absorptive member 34 in the collection box 30 is disposed. Anyway, since the collection box 30 and the absorptive member 34 can be made of an inexpensive material like paper in this invention, the running cost can be reduced.

The holding case 40 which holds the collection box 30 in a detachable manner has a bottom plate 40*a* with an approximately rectangular shape large enough to mount the collection box 30, a front plate 40*b* standing upright almost vertically from one end of the bottom plate 40*a* and two side plates 40*c* and 40*d* which has a shape of an approximately right triangle and couples the bottom plate 40*a* to the front plate 40*b*.

A notch 41 for receiving the two nozzles 52 and 53 of the nozzle unit 50, which will be discussed later, is formed in the upper end of the front plate 40*b*. Protrusively provided on the outer surface of the front plate 40*b* are a pair of bearing sections 42*a* and 42*b* which respectively receive rotary shafts 51*a* and 51*b* of the nozzle unit 50 to be discussed later and rotatably support the nozzle unit 50. Formed in nearly the center of the front plate 40*b* is an opening 43 with an approximately rectangular shape which receives an arc-shaped pressure surface 55 of a rock lever 54 of the nozzle unit 50 to be discussed later.

Provided outside the opening 43 is a sensor 44 (see FIG. 1) which detects a flat section 56 to be detected that is provided at the lower end of the rock lever 54 retreated from the opening 43. The sensor 44 has a light-emitting section and a light-receiving section facing each other with a slit in between, and detects the to-be-detected section 56 when this section 56 comes into the slit. Provided outside the front plate 40*b* is a pin 45 (see FIGS. 5, 6 and 7) on which the α spring 72 for urging the rock lever 54 is installed. One end of the α spring 72 is secured to the bottom plate 40*a*, and the other end is secured to the nozzle unit 50. The α spring 72 always urges the nozzle unit 50 in such a way that the pressure surface 55 of the rock lever 54 is intervened in the holding case 40 through the opening 43 in the front plate 40*b* as shown in FIG. 4. The quantities of the a spring and the pin 45 can be set arbitrarily.

Formed in the bottom plate 40*a* is a recess 46 where the to-be-detected section 56 provided at the lower end of the rock lever 54 received through the opening 43 in the front plate 40*b* is retreated. An engage plate 47 which engages with the associated corner portion of the collection box 30 set in the holding case 40 to prevent the collection box 30 from coming off is provided integrally on the end portion of the bottom plate 40*a* which is opposite to the end where the front plate 40*b* is provided upright.

Rotary shafts 48*a* and 48*b* which are to be fitted in rotary holes 61*a* and 61*b* of the housing 60 to be discussed later when the holding case 40 is installed in the housing 60 protrude from the respective side plates 40*c* and 40*d*. The rotary shafts 48*a* and 48*b* are provided at the portions of the respective side plates 40*c* and 40*d* which extend beyond the front plate 40*b*. The holding case 40 set in the housing 60 is rotatable about the rotary shafts 48*a* and 48*b* and is urged upward by the urging force of the spring 74 intervened between the holding case 40 and the housing 60. The spring 74 is installed between the bottom face of the bottom plate 40*a* of the holding case 40 and the top face of the bottom plate 60*a* of the housing 60 which will be described later. Pins 49*a* and 49*b* which restrict the position of the rotational top end of the holding case 40 are provided on the respective side plates 40*b* and 40*c*, protruding therefrom. When the holding case 40 is urged to the top end position in the housing 60, the pins 49*a* and 49*b* abut on engaging sections 62*a* and 62*b* of the housing 60 which will be described later, thereby restricting the upward rotation of the holding case 40.

The nozzle unit 50 has the pair of rotary shafts 51*a* and 51*b* which are received in the bearing sections 42*a* and 42*b* provided on the front plate 40*b* of the holding case 40. The nozzle unit 50 further has the waste-ink nozzle 52 and the air-discharge nozzle 53 which are to be received in the notch 41 of the front plate 40*b* and in the opening 32 in the collection box 30 set in the holding case 40, when the nozzle unit 50 is installed in the holding case 40. The nozzles 52 and 53 are bent each at about the center and the rotary shafts 51*a* and 51*b* are provided at positions corresponding to the bent portions. That is, when the nozzle unit 50 rotates about the rotary shafts 51*a* and 51*b*, the nozzles 52 and 53 rock.

The liquid-discharge tube 23 connected to the air-liquid separation chamber 19 via the waste-ink pump 22 is connected to the proximal end 52*a* of the waste-ink nozzle 52, and the air-discharge tube 21 connected to the air-liquid separation chamber 19 via the suction pump 20 is connected to the proximal end 53*a* of the air-discharge nozzle 53.

The nozzle unit 50 has the rock lever 54 which extends downward and rotates the nozzle unit 50 about the rotary shafts 51*a* and 51*b* to thereby change the posture of the nozzle unit 50. The rock lever 54 has the arc-shaped pressure surface 55 which is to be received in the opening 43 in the holding case 40. With the nozzle unit 50 installed in the holding case 40, this pressure surface 55 is positioned into the holding case 40 via the opening 43 in the front plate 40*b* of the holding case 40 by the urging force of the α spring 72. The flat to-be-detected section 56, which is detected by the sensor 44 provided in the holding case 40 with the pressure surface 55 retreated from the opening 43, is protrusively provided on the lower end of the rock lever 54.

The housing 60 has an approximately rectangular bottom plate 60*a*, an approximately rectangular side plate 60*b* standing upright at about the right angle from one long side of the bottom plate 60*a*, a top plate 60*c* extending like a cantilever beam from the upper end of the side plate 60*b*, a front plate 60*d* extending at about the right angle from one short side of the side plate 60*b* which extends almost vertically, and a side plate piece 60*e* extending like a cantilever beam from one side of the front plate 60*d* at a position facing the side plate 60*b*. Those plates 60*a*, 60*b*, 60*c* and 60*d* and the side plate piece 60*e* are provided integrally.

The rotary holes 61*a* and 61*b*, which receive the rotary shafts 48*a* and 48*b* of the holding case 40 in a rotatable fashion, are respectively formed in the side plate 60*b* and the side plate piece 60*e*. Formed on the side plate 60*b* and the side plate piece 60*e* are the engaging sections 62*a* and 62*b* which respectively engage with the two pins 49*a* and 49*b* for restricting the rotational top-end position of the holding case 40.

A circular seating 63 for receiving the spring 74 is provided on the top surface of the bottom plate 60*a* which faces the holding case 40. Providing upright on one short side of the bottom plate 60*a* is an abutting section 64 with an approximately rectangular shape which abuts on a part of the bottom plate 40*a* that becomes the rotational distal end of the holding case 40 and stops the holding case 40 at its lower end position. The holding case 40 is rotatable within a given range and is elevatable between predetermined lower and upper end positions by the interaction of the pins 49*a* and 49*b*, the engaging sections 62*a* and 62*b* and the abutting section 64.

In installing the holding case 40 in the housing 60, the spring 74 is placed on the seating 63 of the housing 60 and the rotary shafts 48*a* and 48*b* of the holding case 40 are inserted in the respective rotary holes 61*a* and 61*b* of the housing 60. Under this situation, the rotational distal end of the holding case 40 is urged upward by the urging force of the spring 74, causing the pins 49*a* and 49*b* of the holding case 40 to be engaged with the respective engaging sections 62*a* and 62*b* of the housing 60 and setting the bottom plate 40*a* of the holding case 40 slightly apart upward from the abutting section 64 of the housing 60. FIG. 3 shows this state in which the bottom plate 40*a* of the holding case 40 is held almost horizontally.

Provided near the lower end of the side plate 60*b* is a limit switch 65 which detects the bottom plate 40*a* of the holding case 40 to find out the timing for replacement of the collection box 30. The limit switch 65 has a detection lever 65*a* which is pushed by the bottom plate 40*a*. The limit switch 65 detects the bottom plate 40*a* of the holding case 40 when waste inks are collected from the state in FIG. 3 and the holding case 40 rotates downward due to its weight.

Attached to one end of the top plate 60*c* is a guide roller 66 which rolls in contact with the top surface of the collection box 30 to guide the attachment and detachment of the collection box 30.

Figure 5:
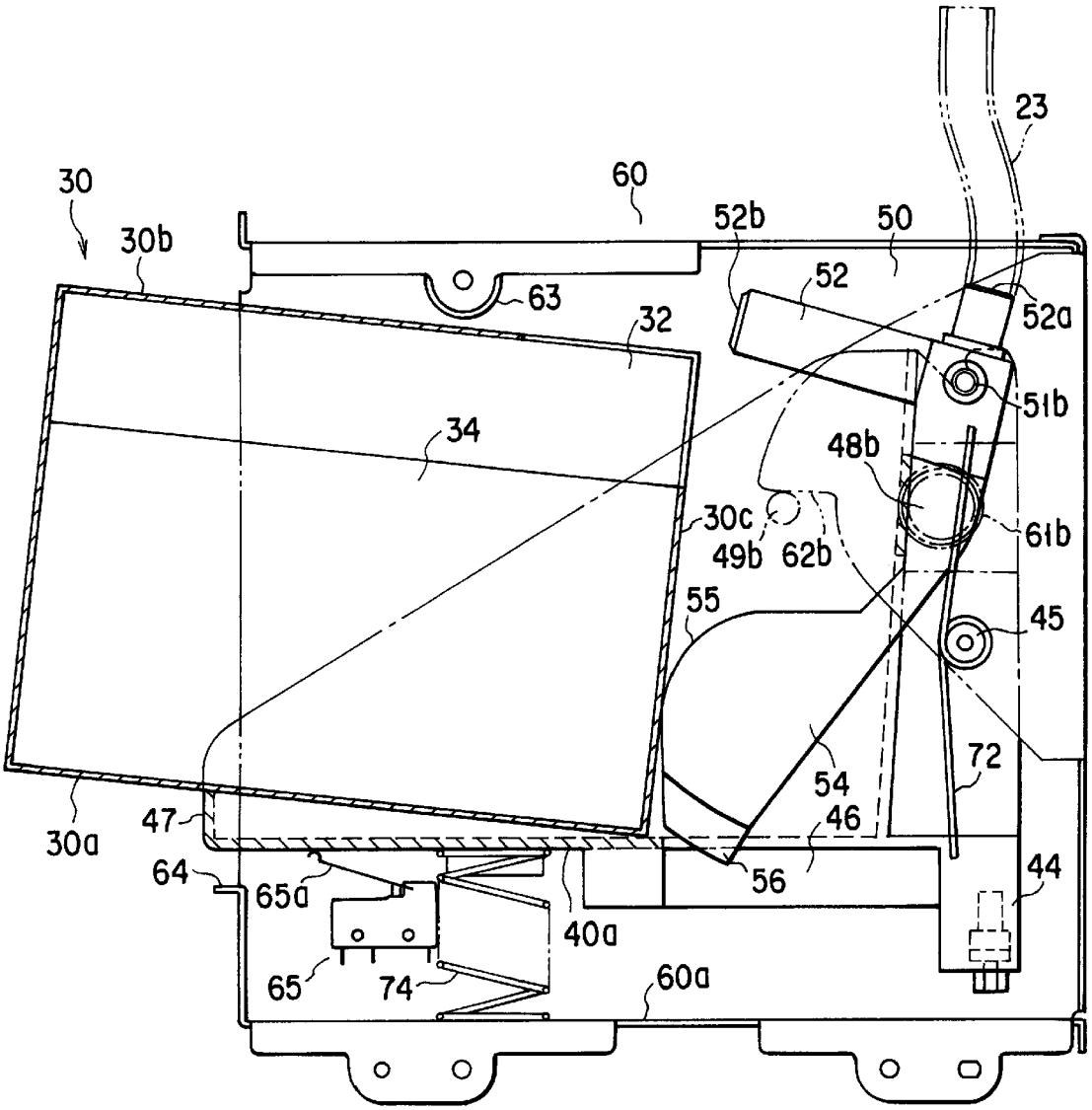
FIG. 5 is a diagram view showing the collection box to be installed in the holding case.
Figure 6:
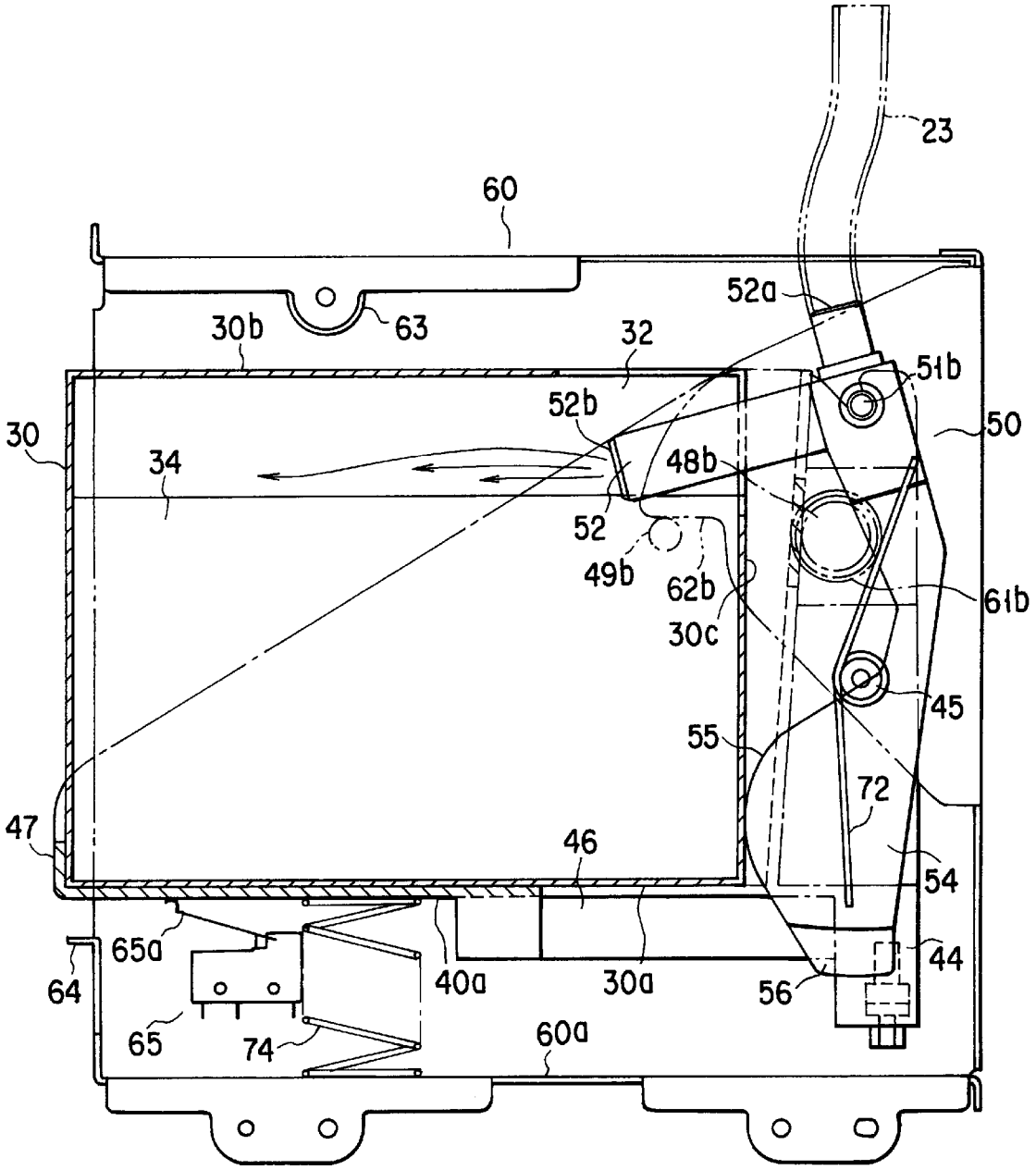
FIG. 6 is a diagram showing the collection box installed in the holding case and waste inks being collected.
Figure 7:
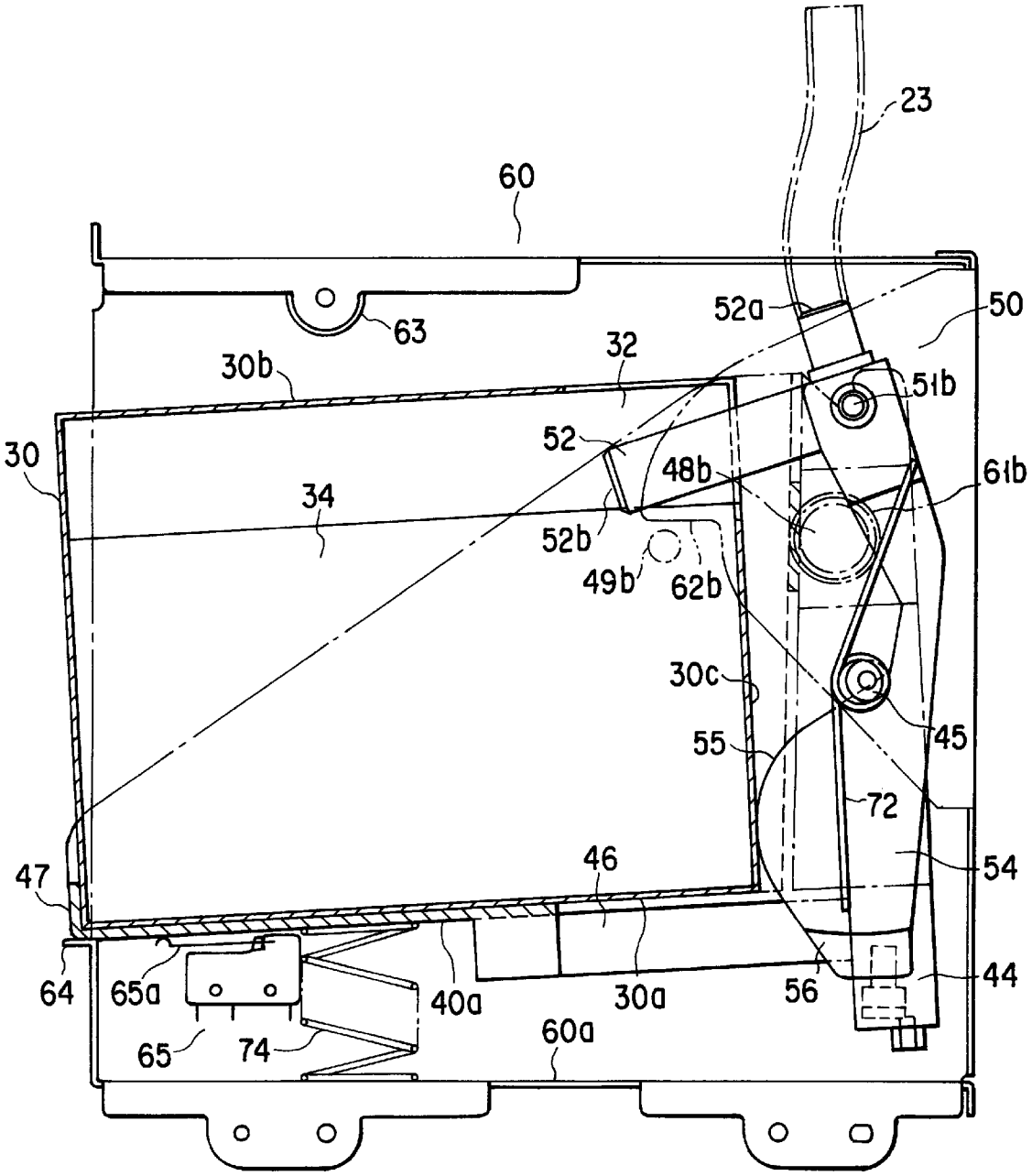
FIG. 7 is a diagram depicting the collection box full of waste ink.

Referring to FIGS. 5 to 7, a description will be given below of the operation of the collecting apparatus 1 from the point of installment of the collection box 30 in the holding case 40 to the point when the collection of waste inks is completed. FIG. 5 shows the collection box 30 to be installed in the holding case 40 set in the housing 60, FIG. 6 shows waste inks and ink mists being collected in the collection box 30, and FIG. 7 shows the collection box 30 full of waste ink.

To install the collection box 30 in the holding case 40 set in the housing 60, as shown in FIG. 5, the bottom face 30*a* of the collection box 30 is guided by the upper end of the engaging plate 47 of the holding case 40 and the top face 30*b* of the collection box 30 is guided by the guide roller 63 of the housing 60. Then, the pressure surface 55 of the rock lever 54 of the nozzle unit 50 is pressed by the front face 30*c* of the collection box 30.

In a state before installment of the collection box 30, the rotary shafts 48*a* and 48*b* of the holding case 40 are rotatably held in the rotary holes 61*a* and 61*b* of the housing 60, the bottom plate 40*a* of the holding case 40 is urged upward by the urging force of the spring 74, and the pins 49*a* and 49*b* of the holding case 40 are engaged with the respective engaging sections 62*a* and 62*b* of the housing 60. In this state, the bottom plate 40*a* of the holding case 40 is set slightly apart upward from the abutting section 64 of the housing 60, and the limit switch 65 is OFF.

In this state, the rock lever 54 of the nozzle unit 50 is urged to the position shown in FIG. 5 (standby position) by the α spring 72. That is, the pressure surface 55 of the rock lever 54 is positioned in the holding case 40 via the opening 43 of the holding case 40. At this time, the to-be-detected section 56 protruding from the lower end of the rock lever 54 is retreated in the recess 46 provided in the bottom plate 40*a* of the holding case 40, and the sensor provided on the holding case 40 is OFF.

When the front face 30*c* of the collection box 30 pushes the pressure surface 55 of the rock lever 54, the rock lever 54 is rocked, against the urging force of the α spring 72, to the position (waste position) where the pressure surface 55 is retreated from the opening 43 of the holding case 40. As a result, the collection box 30 is pushed to a predetermined position in the holding case 40, the lower portion of the rear end of the collection box 30 is engaged with the engaging plate 47 of the holding case 40, causing the collection box 30 to be installed at the predetermined position in the holding case 40. This state is shown in FIG. 6.

In the state is shown in FIG. 6, the waste-ink nozzle 52 and air-discharge nozzle 53 of the nozzle unit 50 are rocked in accordance with the rocking of the rock lever 54, and the distal ends 52*b* and 53*b* of the nozzles 52 and 53 are in slight contact with the top surface of the absorptive member 34 via the opening 32 of the collection box 30. At this time, the nozzles 52 and 53 are tilted from the horizontal state in such a way that the distal ends 52*b* and 53*b* face downward, and come to the waste position where waste inks are disposable. When the collection box 30 is properly installed in the holding case 40 as shown in FIG. 6, the sensor 44 detects the to-be-detected section 56 protruding from the rock lever 54 of the nozzle unit 50 and becomes ON.

Under the condition that the sensor 44 has become ON, it is determined that the collection box 30 has been installed properly and the waste-ink pump 22 and the suction pump 20 are driven to initiate a work of collecting waste inks (ink mists). In other words, the pumps 20 and 22 are interlocked to be driven based on the detection signal from the sensor 44.

When collection of waste inks starts, the absorptive member 34 set in the collection box 30 absorbs waste inks. At this time, the distal ends 52*b* and 53*b* of the nozzles 52 and 53 contact the absorptive member 34, thus preventing the waste inks from scattering and staining the interior of the printer.

When the absorptive member 34 in the collection box 30 absorbs waste inks and the amount of the absorbed waste inks reaches a predetermined amount, the holding case 40 is rotated downward by the weight of the waste inks, causing the bottom plate 40*a* of the holding case 40 to abut on the abutting section 64 of the housing 60. In other words, the urging force of the spring 74 is set in such a manner that the holding case 40 is rotated to the position shown in FIG. 7 when the amount of waste inks collected in the collection box 30 reaches the absorbable amount of the absorptive member 34.

When the holding case 40 is rotated to the position shown in FIG. 7, the detection lever 65*a* of the limit switch 65 is pushed by the bottom plate 40*a* of the holding case 40, setting the limit switch 65 ON. When the limit switch 65 becomes ON, the suction pump 20 and the waste-ink pump 22 are deactivated, completing the collection of waste inks.

A description will now be given of a work of replacing the collection box 30 which has become full of waste inks.

In the state shown in FIG. 7, the collection box 30 which has become full of waste inks is manually pulled out of the holding case 40 by a worker. At this time, the top face 30*b* of the collection box 30 is guided by the guide roller 63. As waste inks are absorbed and held by the absorptive member 34, the waste inks will not drop even when the collection box 30 is tilted. The removed collection box 30 is to be disposed as it is.

When the collection box 30 is removed from the holding case 40, the holding case 40 is hopped up by the urging force of the spring 74 and is returned to an approximately horizontal state. At this time, the rock lever 54 of the nozzle unit 50 is rocked by the urging force of the α spring 72, causing the pressure surface 55 to be received in the holding case 40 through the opening 43. At the same time, the waste-ink nozzle 52 and air-discharge nozzle 53 of the nozzle unit 50 are also rocked, tilting the distal ends 52*b* and 53*b* of the nozzles 52 and 53 upward and setting them to the standby position where waste inks are not disposable. Since the waste-ink nozzle 52 and air-discharge nozzle 53 of the nozzle unit 50 are tilted to the standby position shown in FIG. 5 at the time the used collection box 30 is pulled out, it is possible to prevent waste inks (or ink mists) remaining in the nozzles 52 and 53 from dropping, so that the waste inks will not stain the interior of the printer.

After the used collection box 30 is removed, a new collection box is installed in the holding case 40 in the above-described manner.

According to this embodiment, as described above, the nozzles 52 and 53 of the nozzle unit 50 are set to the waste position at the same time as the collection box 30 is installed in the holding case 40, while the nozzles 52 and 53 of the nozzle unit 50 are set to the standby position at the same time as the collection box 30 is removed. It is therefore possible to simplify the structure for connecting the collection box 30 to the nozzles 52 and 53. This can ensure quicker attachment and detachment of the collection box 30 and facilitate replacement of the collection box 30. Because the distal ends of the nozzles 52 and 53 are tilted upward with the nozzles 52 and 53 are set to the standby position, waste inks will not drop at the time of replacing the collection box 30, preventing the waste inks from staining the peripheral members.

This invention is not limited to the above-described embodiment, but may be modified in various other forms within the spirit or scope of the invention. Although the foregoing description of the embodiment has been given with reference to the structure that is associated with an ink of a single color, this invention is not limited to this type but may be adapted to an ink-jet printer which uses inks of four colors as shown in FIG. 8.

Figure 8:
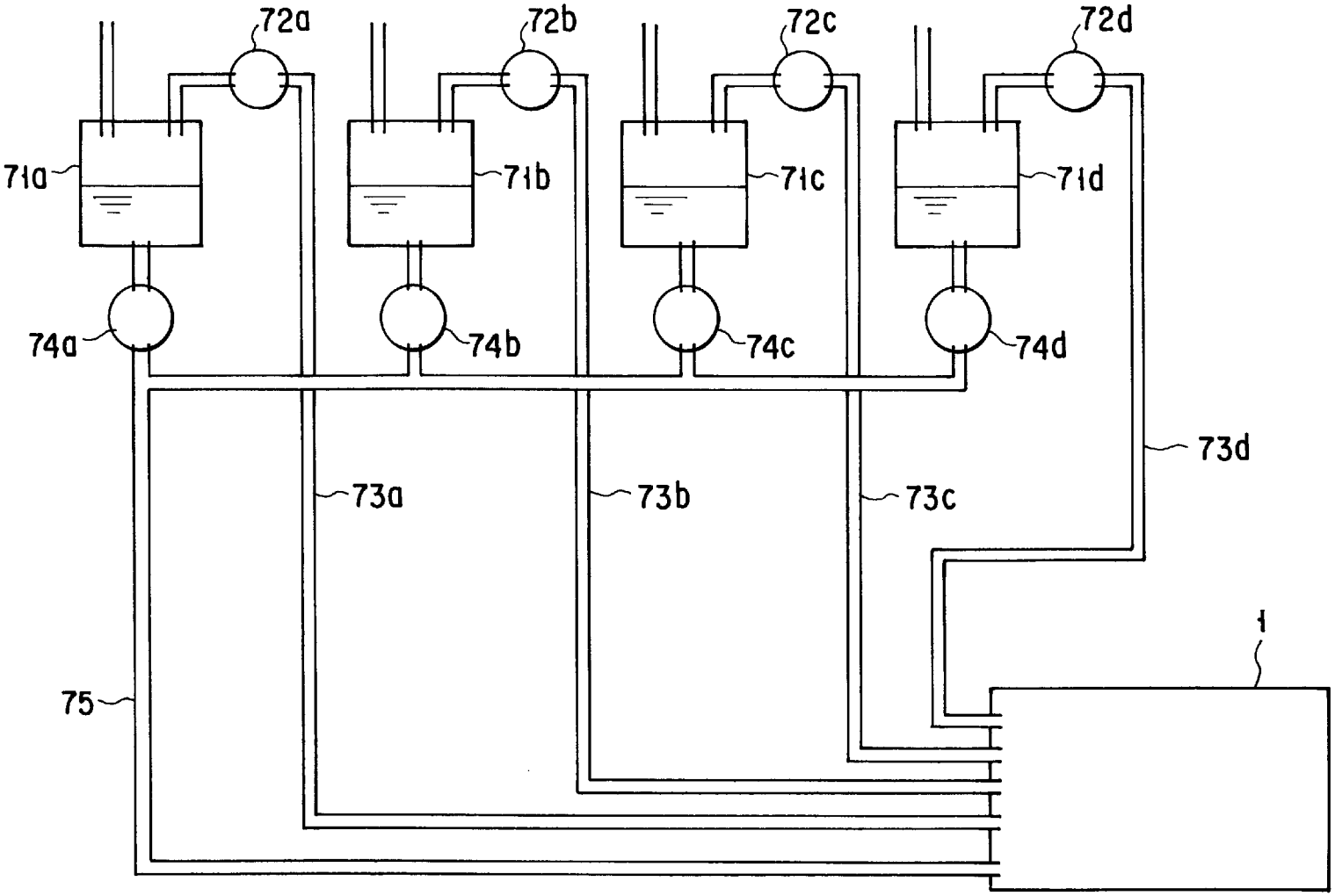
FIG. 8 is a schematic diagram exemplifying the structure of this invention as adapted to an ink-jet printer which uses four color inks.

The apparatus in FIG. 8 has four air-liquid separation chambers 71*a*, 71*b*, 71*c* and 71*d* for sucking waste inks of the individual colors that are discharged from unillustrated recording heads for the respective colors. Suction pumps 72*a*, 72*b*, 72*c* and 72*d* for generating negative pressures in the respective chambers are respectively connected to the chambers, and the air-discharge ends of the individual suction pumps are connected to the collecting apparatus 1 via respective air-discharge tubes 73*a*, 73*b*, 73*c* and 73*d*. Waste-ink pumps 74*a*, 74*b*, 74*c* and 74*d* are respectively connected to the bottom plates of the chambers 71*a*, 71*b*, 71*c* and 71*d*, and the liquid-discharge ends of those waste-ink pumps are connected to a single liquid-discharge tube 75 which is connected to the collecting apparatus 1.

The four air-discharge tubes 73*a*, 73*b*, 73*c* and 73*d* and one liquid-discharge tube 75 are connected to the above-described nozzle unit 50, so that waste inks and ink mists of the individual colors will be absorbed and held by the absorptive member 34 of the collection box 30 in the above-described manner.

The provision of the four air-discharge tubes 73*a*, 73*b*, 73*c* and 73*d* for discharging ink mists of the individual colors can prevent noise from being generated by air discharge and can reduce the height of the nozzle unit 50. That is, since a relatively small amount of a waste ink flows in each of the waste-ink pumps 74*a*, 74*b*, 74*c* and 74*d*, the single liquid-discharge tube 75 does not cause a problem of noise, while if the individual air-discharge tubes are replaced with a single tube, the air-discharging sound becomes louder. In this respect, four air-discharge tubes are provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A waste-ink collecting apparatus comprising:

a collection box that collects waste ink;

a holding case that retains said collection box in a detachable manner;

a nozzle unit attached to said holding case, said nozzle unit having a nozzle that disposes waste ink to said collection box and being movable between a waste position where said waste ink is disposable through said nozzle and a standby position where said waste ink is prevented from dropping; and an urging member that urges said nozzle unit to said standby position, means for moving said nozzle unit to said waste position against an urging force of said urging member when said collection box is installed in said holding case, and for causing said urging member to move said nozzle unit to said standby position when said collection box is installed in said holding case.

2. The waste-ink collecting apparatus according to claim 1, wherein with said nozzle unit set to said waste position, said nozzle is tilted in such a way that an end portion of said nozzle is directed downward, and with said nozzle unit set to said standby position, said nozzle is tilted in such a way that said end portion thereof is directed upward.

3. The waste-ink collecting apparatus according to claim 2, wherein said collection box comprises an absorptive member which contacts said end portion of said nozzle when said nozzle unit is set to said waste position.

4. The waste-ink collecting apparatus according to claim 3, wherein said absorptive member comprises a plurality of paper sheets, and wherein when said absorptive member is retained in said collection box said plurality of paper sheets extend substantially vertically.

5. The waste-ink collecting apparatus according to claim 3, wherein said absorptive member is formed by accordion-folding at least a single paper sheet and is retained in said collection box in such a way that accordion-folded portions of said paper sheet extend substantially vertically.

6. The waste-ink collecting apparatus according to claim 1, wherein said nozzle unit comprises rotary shafts rotatably mounted on said holding case and a rock lever which is pushed by said collection box at a time of attaching said collection box in said holding case and is rocked about said rotary shafts, and wherein said nozzle unit is rotated between said waste position and said standby position in accordance with rocking of said rock lever.

7. The waste-ink collecting apparatus according to claim 6, wherein with said nozzle unit rotated to said waste position, said nozzle is tilted in such a way that a first end of said nozzle is directed downward, and wherein with said nozzle unit rotated to said standby position, said nozzle is tilted in such a way that said first end is directed upward.

8. The waste-ink collecting apparatus according to claim 7, wherein said collection box comprises an absorptive member which contacts said first end of said nozzle when said nozzle unit is rotated to said waste position.

9. The waste-ink collecting apparatus according to claim 8, wherein liquid-discharge tubes, connected to a second end of said nozzle, lead out via a waste-ink pump from a bottom of an air-liquid separation chamber that sucks said waste ink from an ink-jet printer by negative pressure to thereby separate said waste ink into a liquid component and an air component.

10. The waste-ink collecting apparatus according to claim 9, further comprising a sensor that detects said rock lever being pushed by said collection box to thereby detect installment of said collection box at a predetermined position in said holding case, whereby under a condition that pushing of said rock lever has been detected by said sensor, said waste-ink pump is driven to permit said waste ink to be disposed through said nozzle.

11. The waste-ink collecting apparatus according to claim 9, wherein said nozzle unit further comprises an air-discharge nozzle for discharging ink mist connected to a disposing tube connected via a suction pump to an upper portion of said air-liquid separation chamber, and wherein said air-discharge nozzle operates in synchronism with said nozzle.

12. The waste-ink collecting apparatus according to claim 11, wherein said nozzle unit comprises four air-discharge nozzles for respective four colors.

13. The waste-ink collecting apparatus according to claim 1, further comprising a limit switch that senses collection of a predetermined amount of waste-ink in the collection box, whereby a time for exchanging said collection box is determined when said limit switch senses that the predetermined amount of waste-ink is collected in the collection box.

14. A waste-ink collecting apparatus comprising:

a collection box retaining an absorptive member that absorbs and holds waste ink;

a holding case that retains said collection box in a detachable manner;

a nozzle unit rotatably attached to said holding case, said nozzle unit having a nozzle that disposes waste ink to said absorptive member and being rotatable between a waste position where said waste ink is disposable through said nozzle and a standby position where said waste ink is not disposable;

a first urging member, provided between said holding case and said nozzle unit, that urges said nozzle unit to said standby position;

a housing accommodating said holding case in an elevatable manner between a predetermined upper end position and a predetermined lower end position; and a second urging member, provided between said housing and said holding case, that urges said holding case to said upper end position;

whereby installing said collection box in said holding case rotates said nozzle unit to said waste position against an urging force of said first urging member, and removing said collection box from said holding case causes said first urging member to rotate said nozzle unit to said standby position, and wherein said holding case is elevated downward to said lower end position by a dead weight thereof against an urging force of said second urging member when said absorptive member absorbs a predetermined amount of waste ink.

15. The waste-ink collecting apparatus according to claim 14, further comprising a limit switch that detects said holding case being elevated down to said lower end position, whereby a time for replacement of said collection box is determined under a condition that said limit switch has detected said holding case being elevated down to said lower end position.

* * * * *